US006245031B1

(12) United States Patent
Pearson

(10) Patent No.: US 6,245,031 B1
(45) **Date of Patent: *Jun. 12, 2001**

(54) MASSAGE SYSTEM

(76) Inventor: Roger C. Pearson, 324 Snead Dr., Fairfield Glade, TN (US) 38558

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/999,046

(22) Filed: Dec. 29, 1997

(51) Int. Cl.[7] ..... A61H 15/00

(52) U.S. Cl. ..... 601/118; 601/129; 601/135; 601/130

(58) Field of Search ..... 601/134, 135, 601/128, 129, 131, 118, 130

(56) References Cited

U.S. PATENT DOCUMENTS

| | | | | |
|---|---|---|---|---|
| D. 408,925 | * | 4/1999 | Berry et al. | D24/214 |
| D. 428,997 | * | 8/2000 | Berry et al. | D24/214 |
| 693,064 | * | 2/1902 | Proben et al. | 601/129 |
| 744,718 | * | 11/1903 | Cassidy et al. | 601/131 |
| 1,615,910 | * | 2/1927 | Nuyts | 601/129 |
| 2,156,839 | * | 5/1939 | Buffalow | 601/128 |
| 2,633,844 | * | 4/1953 | Herndon | 601/128 |
| 4,846,159 | | 7/1989 | Anzai et al. | 128/57 |
| 5,152,281 | * | 10/1992 | Koll | 601/118 |
| 5,580,336 | * | 12/1996 | Coallier | 601/129 |

FOREIGN PATENT DOCUMENTS

| | | | |
|---|---|---|---|
| 2194153 | * | 3/1988 | (GB) . |
| 2003323 C1 | * | 11/1993 | (RU) . |

* cited by examiner

*Primary Examiner*—Michael A. Brown
*Assistant Examiner*—Benjamin Koo
(74) *Attorney, Agent, or Firm*—Luedeka, Neely & Graham, P.C.

(57) ABSTRACT

A massage system including a carrier and a plurality of pressure applicators rotatably and releasably mountable to the carrier, wherein the carrier covers less than about 25% of the surface area of each pressure applicator.

27 Claims, 6 Drawing Sheets

MASSAGE SYSTEM

FIELD OF THE INVENTION

This invention relates generally to devices for accomplishing massage therapy. More particularly, this invention relates to a device for massaging humans and animals.

BACKGROUND AND SUMMARY OF THE INVENTION

Massage therapy is well known and it has been experienced that creating a magnetic field in association with the therapy may enhance any effect of the massage. However, conventional massage therapy devices are often disadvantageous when used to massage certain areas of the body which are difficult to access, such as the neck or under the arm. For example, devices of the type having a carrier and magnetic balls, such as described in U.S. Pat. No. 4,846,159 are disadvantageous for certain uses in that exposure of the balls to the body is compromised as a significant portion of each ball is inside the carrier and is not available for contacting the body. Also, accomplishing such massage without assistance is often difficult, particularly when the area of the body to be treated is difficult to reach, such as ones back. Thus, there is a need in the art for a device that enables self massage of hard to reach areas and in particular for an improved carrier.

Accordingly, it is an object of the invention to provide an improved device for accomplishing massage therapy.

Another object of the invention is to provide a device of the character described which enables a user to massage difficult to reach body portions.

An additional object of the invention is to provide a device of the character described which facilitates massage therapy as compared to conventional devices.

A further object of the invention is to provide a device of the character described which is suitable for accomplishing massage of virtually the entire body.

Yet another object of the invention is to provide a device of the character described which is suitable for use by an individual for self massage.

A still further object of the invention is to provide a massage system having a carrier and pressure applicators mountable to the carrier wherein the carrier is configured to maximize exposure of the pressure applicators to the body of the user.

Still another object of the invention is to provide a device of the character described which is cost effective and uncomplicated in configuration With regard to the foregoing and other objects, the invention provides a massage system Including a carrier and at least one pressure applicator rotatably and releasably mountable to the carrier, wherein the carrier covers less than about 25% of the surface area of the pressure applicator.

In another aspect, the invention relates to a massage system including a carrier and a plurality of pressure applicators rotatably and releasably mountable to the carrier. The carrier is graspable by a user for manipulation by the user to movably bear the pressure applicators against body portions of the user or body portions of others, the carrier being configured to maximize exposure of the pressure applicators to the body portions and including an elongate handle portion configured for grasping by a hand of the user and a mounting section for rotatably and releasably receiving the pressure applicators, the mounting section covering less than about 25% of the surface area of each pressure applicator.

A significant aspect of the invention relates to the provision of a carrier which enables at least about 75% of the surface area of the pressure applicators to be exposed for contact with the body of a user at any moment. This is advantageous in that it enables use of the massage device in otherwise difficult to access areas and further facilitates use of the massage system by oneself. Thus, the system of the invention enables a greater percentage of the body of the massage recipient to be massaged as compared to prior devices.

BRIEF DESCRIPTION OF THE DRAWINGS

The above and other features and advantages of the present invention will become further known from the following detailed description considered in conjunction with the accompanying drawings in which.

DETAILED DESCRIPTION

Figure 1:
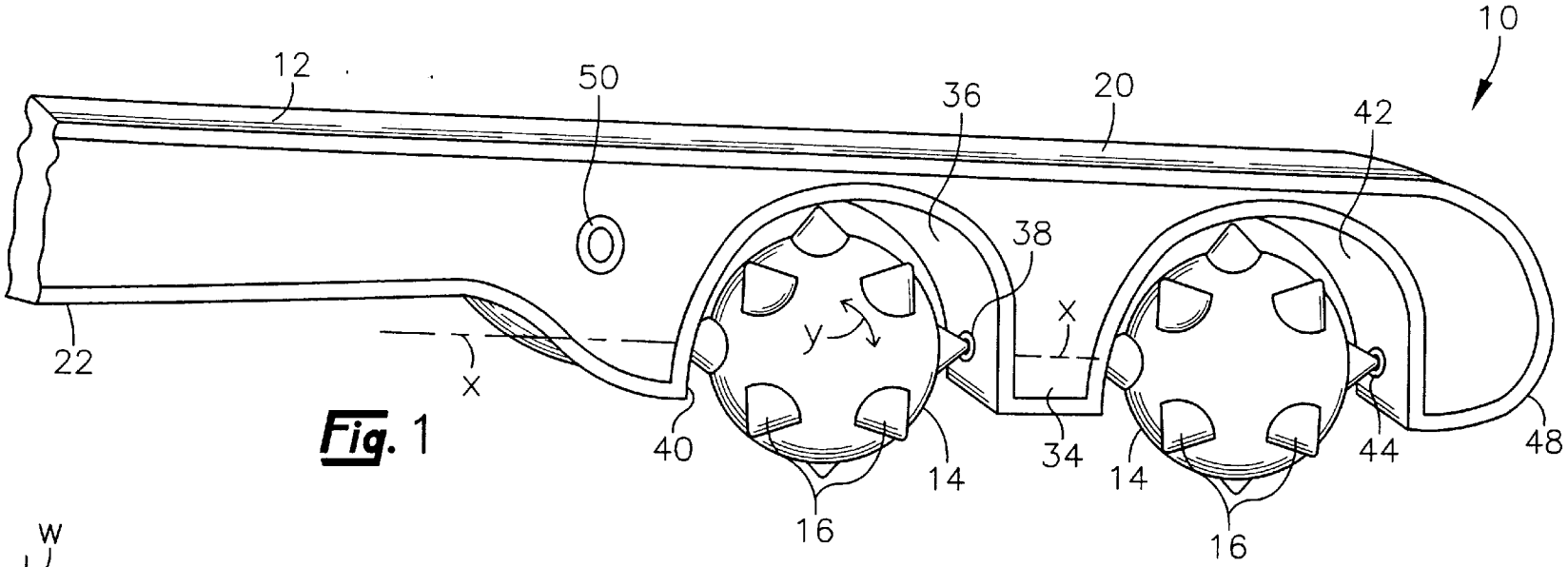
FIG. 1 is a perspective view showing a massage system according to the invention.

With initial reference to FIG. 1, there is shown a massage system 10 in accordance with a preferred embodiment of the invention. The system 10 preferably includes, as major components, a carrier 12 and one or more pressure applicators 14 rotatably and releasably mountable to the carrier 12. In use, the carrier is manipulated by a user in such a manner that the pressure applicators 14 are simultaneously rolled and lightly pressed against portions of the body of the user or of another person desiring massage therapy. The carrier 12 is configured to maximize exposure of the pressure applicators 14 to the body of the user.

The preferred pressure applicators for use with the system 10 of the invention are magnetized balls available under the trade name MAGBOY from Nihon Kenko Zoushin Kenyukai Corp. of Fukuoka, Japan and described in U.S. Pat. No. 4,846,159, entitled MASSAGE APPARATUS, incorporated herein by reference in its entirety. The use of magnetized pressure applicators is believed to be particularly advantageous for the purpose of enhancing blood circulation, particularly if the magnetized applicators are rotated at a sufficiently high rate.

It will be understood, however, that the carriers may be used with other pressure applicators and the pressure applicators may be of shapes other than balls, such as three-dimensional polygons, it being preferred that they be symmetrical and are contoured so as to provide a pleasurable sensation when rolled along the body of a user. The magnetized balls described in the '159 patent have a diameter of about 28 mm (about 1.1 inches) and include twelve conical projections 16 on their outer periphery. The projections 16 have rounded tips and a height of about 4 mm (0.16 inch)and a diameter at their base of about 10 mm (0.4 inch). However, it will be understood that balls, projections of other dimensions and shapes of other dimensions may be used as pressure applicators.

The pressure applicators 14 are also preferably contoured to engage the body in a manner which does not provide an unpleasant sensation or otherwise damage the skin of the user. That is, it is preferred that all surfaces be somewhat rounded so that relatively sharp points are not present. The carrier may carry one or more pressure applicators, preferably two, with any plurality of applicators being positioned in-line as shown in FIG. 1.

Figure 2:
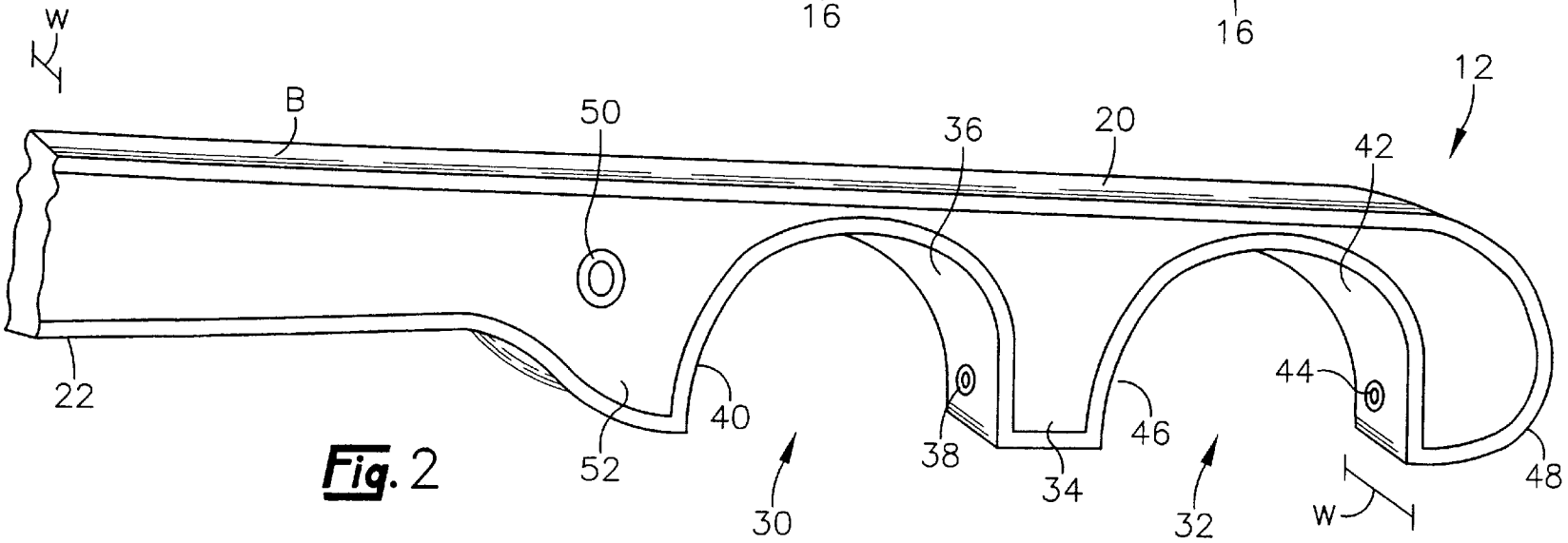
FIG. 2 is a perspective view of a component of the system of FIG. 1.
Figure 3:
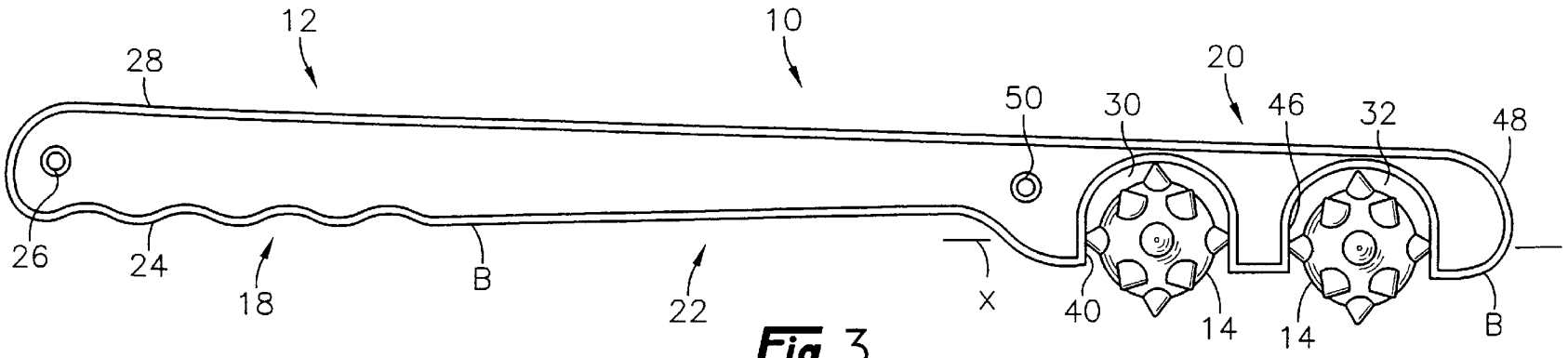
FIG. 3 is a right side view of the system of FIG. 1, it being understood that the left side view is identical thereto.
Figure 4:
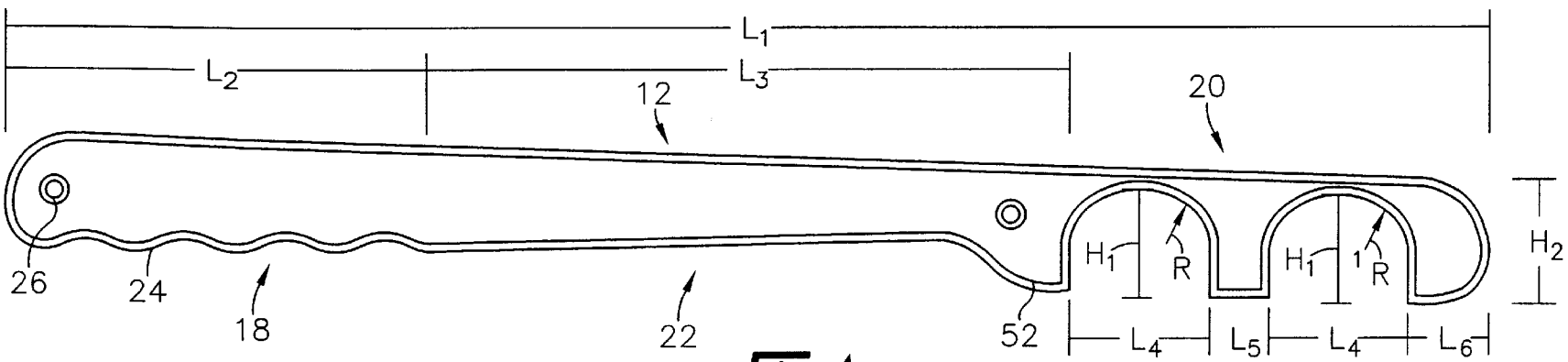
FIG. 4 is a right side view of the component of FIG. 2.

Turning now to FIGS. 2–4, the carrier 12 is preferably of one-piece construction and made of wood as by sawing, using a router, scroll or band saw. The entire perimeter of the carrier is preferably beveled to enhance the aesthetics of the carrier and to avoid the provision of corner surfaces which might unpleasantly contact the body of the user. In this regard, the perimeter of the carrier, on both sides, preferably includes a continuous and inwardly angled bevel B having a width of from about one-sixteenth to about one-eighth inch. The bevel may be of uniform width or varied around the perimeter.

It will be understood that the carrier may be made of virtually any substantially rigid material such as a polymer plastic, a glass fiber composite, a carbon fiber composite, metal and the like, however, wood is preferred due to its pleasing feel in the hand and to its ability to absorb vibration caused by rapid travel of the applicators over the skin and to dampen noise associated with use of the system 10 to provide massage therapy. Recall that the applicators 14 are preferably magnetized and, when rotated about a common axis, generate interactive force fields causing the pressure applicators to vibrate about respective axes. Particularly preferred wood species include hardwoods such as cherry, walnut, maple, oak, hickory and beech.

The carrier 12 preferably includes an elongate handle portion 18 configured for grasping by the hand of the user and a mounting section 20 for rotatably and releasably receiving the pressure applicators 14. In addition, an extension section 22 is preferably included in between the handle portion 18 and the mounting section 20 to extend the reach of the massage system and multiply user hand movement of the massage system. The extension section 22 is particularly advantageous when, for example, the user desires to massage his own back or other locations which are generally difficult to reach. The handle portion preferably has a width of about 0.5 inch and is tapered so that the width of the carrier beginning at the mounting section is about 0.4 inches. It will be understood, however, that the width of the carrier can vary significantly, with the width generally being selected to provide a carrier that is strong and easily manipulated by the user and which avoids shielding the pressure applicators from the body of the user.

The handle portion 18 preferably has a lower surface 24 contoured to facilitate grasping of the handle portion by the hand of the user, with an aperture 26 preferably provided through the handle portion proximate its free end to facilitate hanging of the system from a hook when not in use or for receiving a strap that may be secured to a wrist of the user. In this regard, the aperture 26 is primarily available for receiving a pin associated with a jig used during the manufacture of the carrier. Upper surface 28 of the handle portion 18, as well as the upper surfaces of the mounting section 20 and extension section 22 are preferably substantially flat and smooth.

The mounting section 20 preferably includes a pair of spaced apart generally arch-shaped cutouts 30 and 32, each configured for receiving one of the pressure applicators 14. An intermediate portion 34 extends between the cutouts 30 and 32. The cutout 30 includes an arch shaped sidewall 36 having generally conical-shaped detents 38 and 40 formed adjacent opposite lower ends thereof and each configured for receiving one of the projections 16 in a manner which enables the projection to spin in the detent. As will be appreciated, the detents may also be provided by similarly shaped inserts, such as metal or ceramic or other low friction surface attached to the sidewall as by adhesive.

The detents 38 and 40 lie in a common plane and are each configured to receive one of the projections 16 of the pressure applicators 14. In this regard, it will be appreciated that the cutout 30 is sized and the detents 38 and 40 positioned so that one of the pressure applicators 14 may be snap-fit into the cutout for frictional retention thereof. In this regard, the term "frictional retention" will be understood to refer to retention of the applicator 14 within the cutout 30, that is, it is held in place within the cutout, but is able to rotate or spin around the axis defined by the imaginary line X extending between the projections 16 captured within the detents 38 and 40, and in general direction of the arrow Y.

To facilitate insertion of the applicator 14 into the cutout 30, a divot or notch 39 (FIG. 6) is preferably provided on lower surface 41 of the mounting section adjacent the lower end of the sidewall 36 just below the detent 40. The notch 39 enables the user to more easily position the applicator 14 in the cutout. For example, the user may place one of the projections of the pressure applicator into detent 38 and rest the opposite projection 16 in the notch 39. From this orientation pressure may be applied to the applicator to urge the projection in the notch 39 toward and into the detent 40 for attachment of the applicator to the carrier. It is preferred that the foregoing positioning sequence be accomplished with the carrier supported in the hand of the user with the cutouts pointing upwardly.

The cutout 32 is similarly configured and preferably includes sidewall 42 having detents 44 and 46, with the cutout 32 provided between the intermediate portion 34 and a rounded end portion 48 of the section 20. Likewise, a notch 47 is preferably provided on surface 49 below the detent 46. An aperture 50 preferably extends through section 52 of the section 20 joining the section 20 to the section 22. The aperture 50 may also be used for receiving a strap or the like, but is primarily provided to facilitate manufacture of the carrier by receiving a jig.

For the purpose of an example, the carrier 12 is preferably dimensioned as set forth below when used in conjunction with the magnetized balls described in U.S. Pat. No.

4,846,159 and having a diameter of about 28 mm and including twelve conical projections:

| Dimension | Approx. Distance (inch) |
|---|---|
| W | 0.4 |
| L1 | 13.0 |
| L2 | 4.5 |
| L3 | 5.0 |
| L4 | 1.2 |
| L5 | 0.4 |
| L6 | 0.7 |
| H1 | 0.85 |
| H2 | 1 |
| R | 0.6 (radius) |

Figure 6:
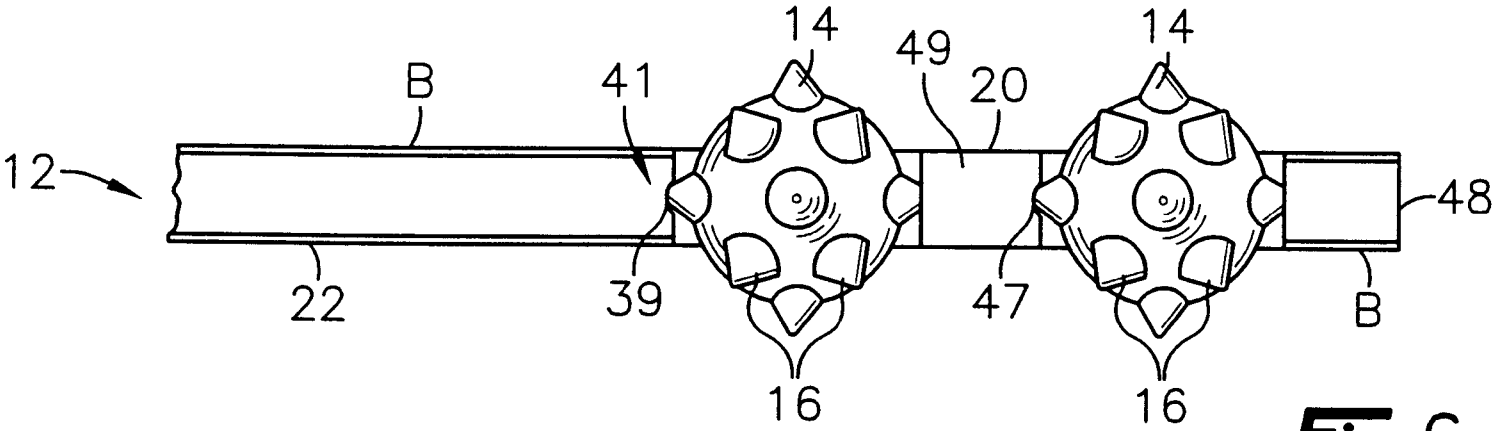
FIG. 6 is a bottom plan view of the system of FIG. 1.
Figure 5:
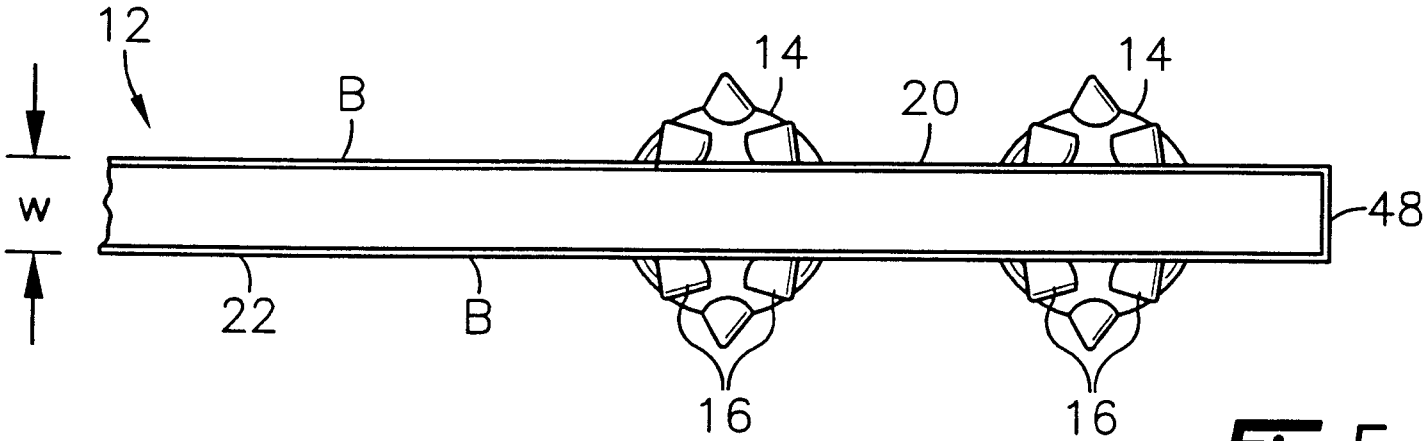
FIG. 5 is a top plan view of the system of FIG. 1.

As will be noted, and as is particularly noticeable with reference to FIGS. 5 and 6, the carrier 12 is configured to maximize exposure of the pressure applicators 14 to the body of the user. This is a significant aspect of the invention in that enables use of the massage system on body areas which, generally, are not suitably treatable by use of conventional devices. For example, under the arm and around the neck and in other areas having significant contours.

In this regard, it will be appreciated that the carrier 12 is preferably configured to expose at least about 75% of the outer surface area of each pressure applicator 14 so that such surface area is available for contacting the body of the user. For the purpose of illustrating this aspect, the general equation for determining the surface area of a sphere is $4\pi r^2$, wherein r is the radius of the sphere, such that the total surface area of each pressure applicator having a diameter of 28 mm or a radius of 14 mm is $4\pi(14)^2=2463$ mm$^2$ or 3.8 in$^2$. With regard to this calculation, it will be understood that the actual surface of the pressure applicator 14 is greater than that calculated above given the fact that the equation assumes a smooth sphere and not one having projections such as the projections 16. Thus, the inclusion of the surface area of the projections would increase the total surface area of the sphere. However, for the purpose of simplification of the calculation, it will be assumed that the pressure applicators 14 are smooth spheres except for the portions thereof that engage the detents to maintain the applicator on the carrier.

Figure 7:
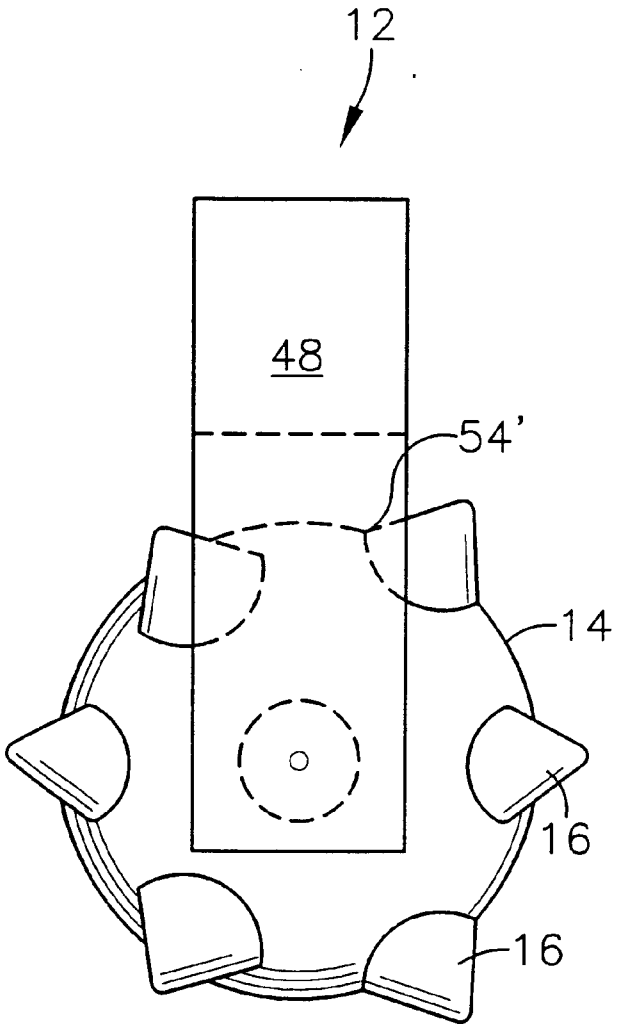
FIG. 7 is an enlarged front plan view of the system of FIG. 1.

With respect to the described carrier 12, it may be seen with reference to FIGS. 5–7 that the carrier covers only a relatively small portion of the surface of the pressure applicators. In this regard, the terminology "covered area" or "covered portion" refers to the portion of the pressure applicator that is unexposed at any given moment and thus cannot come into contact with the body of the user at any given time. Thus, if 25% of the pressure applicator is "covered by the carrier", then 75% is exposed and is available to contact the body of the user.

For the described carrier 12 having a width W adjacent the mounting section 20 of about 0.4 inches, it will be noted that the carrier 12 extends about one-half the diameter of one of the projections 16 below the midpoint of the pressure applicator. As noted above, each projection has a base diameter of about 10 mm (0.4 inch). Thus, the portion of the applicator that is covered is U-shaped portion of the applicator having a width of about 0.4 inches and extending about 0.2 inches (5 mm) below the midpoint of the applicator.

Figure 8:
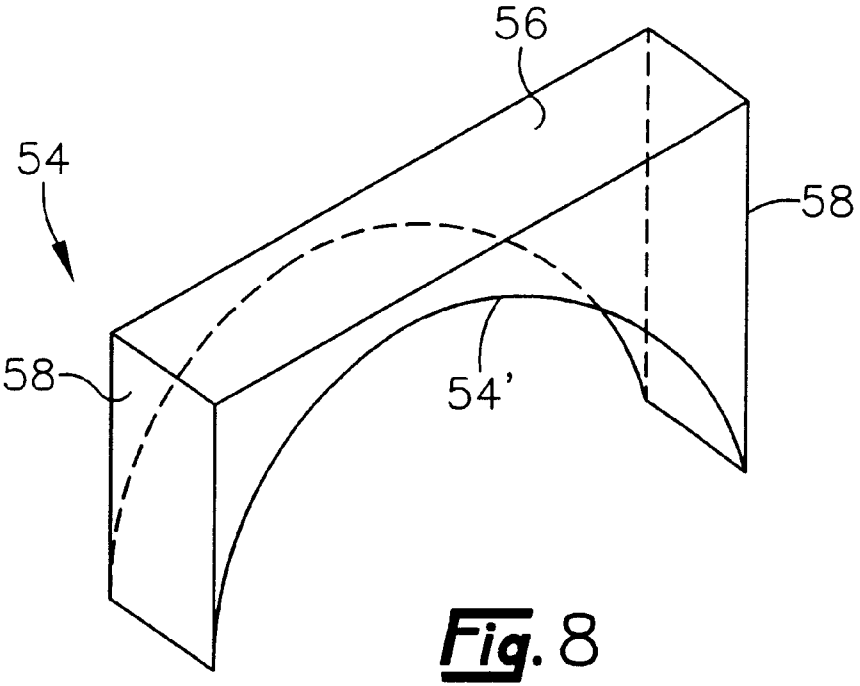
FIG. 8 is a representational view which illustrates coverage of pressure applicators by the carrier, it being an object of the invention to provide a carrier which minimizes the surface area of the pressure applicators that are covered or under the carrier.

To facilitate calculation of the covered area, it is assumed that the covered area is linear and not curved such that the covered portion is a portion of a square 54 as shown in FIG. 8. As will be appreciated, the surface area of the square portion of FIG. 8 is greater than that of the actual covered portion of the applicator 14, which is shown for the purpose of comparison as curved portion 54' shown in FIGS. 7 and 8.

The covered portion 54 has a top surface 56 having a length of about 28 mm (1.1 inches) and a width of about 0.4 inches (10 mm), and a pair of side surfaces 58 extending down from the top surface 54, with each surface 56 having a length of about 16 mm (½ the radius +½ the base of the projection) and a width of about 0.4 inches (10 mm). Thus, the area of the covered portion 54 is about $(28\times10)+2(16\times10)=600$ mm$^2$ or 0.93 in$^2$. Accordingly, the covered portion 54 represents, at the most, less than about 25% 600 (600 /2463×100=24.4%) of the total surface area of the applicator 14. In this regard, it will be appreciated that the actual covered surface of each pressure applicator is considerably less than 25% when the surface area of the projections and the smaller true surface area of the covered portion 54' shown in FIG. 7 are considered.

To the contrary, prior art devices such as described in U.S. Pat. No. 4,846,159 have carriers which cover in excess of 25% of the surface of the balls, typically covering in excess of 50% of the surface of the balls.

It will therefore be understood that a significant advantage of the invention relates to the provision of a carrier which enables at least about 75% of the surface area of the pressure applicators 14 to be exposed for contact with the body of a user at any moment. This is advantageous in that it enables use of the massage device in otherwise difficult to access areas and further facilitates use of the massage system by oneself Thus, the system of the invention enables a greater percentage of the body of the massage recipient to be massaged as compared to prior devices.

It has further been experienced that the massage system of the invention is also more suitable for use to effect massage therapy to non-humans, such as dogs horses and cats. For example, it has been observed that the system 10 facilities the massage of body contours of dogs as compared to prior devices in that the carrier 10 is more easily manipulated along the contours of a dog and the less enclosed pressure applicators as mounted on the carrier 14 more readily effect massage on such contours.

Additionally, it has been experienced that the carrier according to the invention more effectively attenuates noise associated with the rendering of massage therapy using conventional devices, that is noise created by the movement of the pressure applicators relative to the carrier, and is thus quieter in operation.

Figure 9:
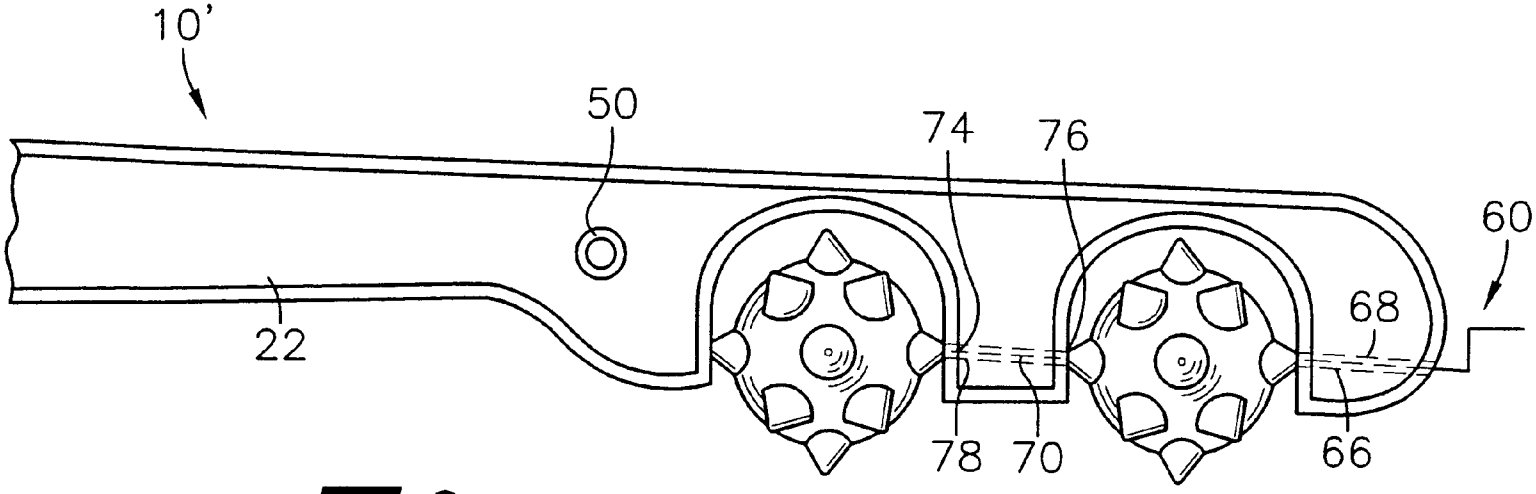
FIG. 9 is a side view of another embodiment of a carrier according to the invention.

The carrier also advantageously provides a relatively low friction retention of the applicators 14 which enables the applicators to be spun with relative ease. This facilitates the development of a magnetic field and further enables a magnetic field to be developed by spinning the applicators absent contact of the applicators with the skin of the user. This enables application of a magnetic field to an area that is tender or swollen such that direct contact would be painful. Accordingly, with reference to FIGS. 9, 9*a* and 9*b* there is shown another embodiment of a carrier 10' having a mechanical crank 60 for accomplishing spinning of the applicators without contact of the applicators with the skin of the user.

The crank 60 preferably includes a generally Z-shaped metal rod 62 having at one end a cup 64 shaped in the manner of the detent 44 for receiving one of the projections 16 and positioned to serve as the detent 44. Portion 66 of the rod 62, the free end of which the cup 64 is attached to is preferably inserted through bore 68 which extends from end portion 48 into cutout 32 and the cup 64 thereafter attached as by threads or adhesive or solder or other fastening device.

As will be appreciated, when the applicators are magnetized rotation of one applicator 14 causes the other to rotate due to their magnetic properties. However, if desired, a connector 70 may be provided to directly connect the applicators.

Figure 9B:
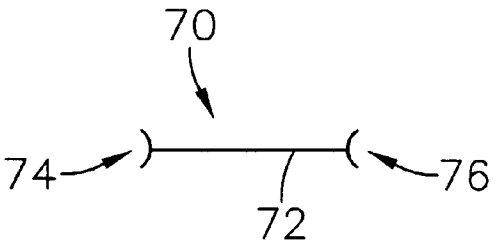
FIG. 9*b* is a detailed view of a connector for use with the carrier of FIG. 9.
Figure 9A:
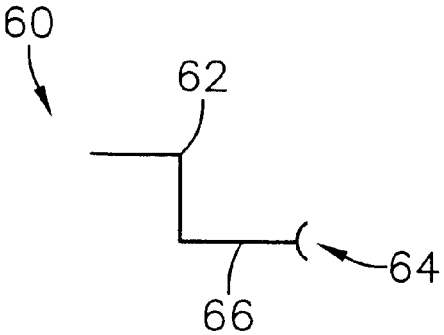
FIG. 9*a* is a detailed view of a crank for use with the carrier of FIG. 9.

For example, with reference to FIG. 9*b*, connector 70 may be provided as by a rod 72 having cups 74 and 76 provided at either end, the rod 72 extending through bore 78.

Figure 10A:
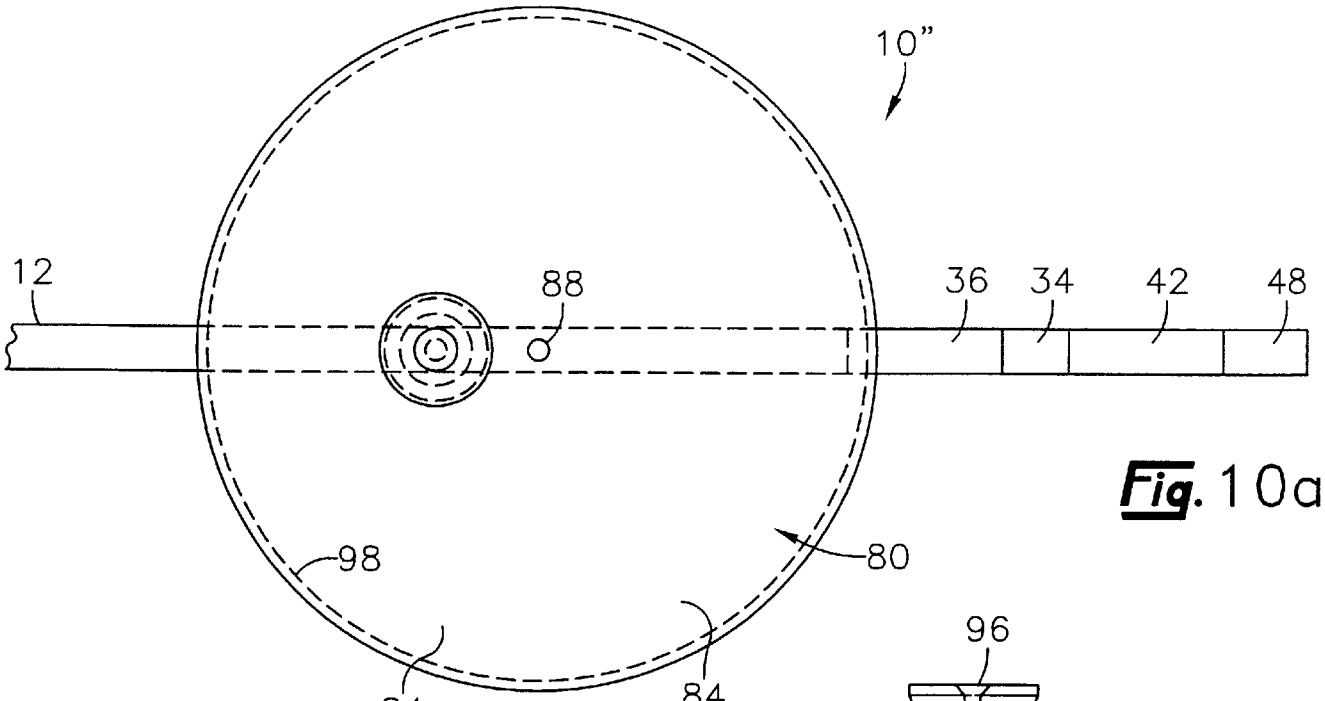
FIG. 10*a* is a top plan view of another carrier according to the invention and FIG. 10*b* is a side plan view of the carrier of FIG. 10*a*.
Figure 10B:
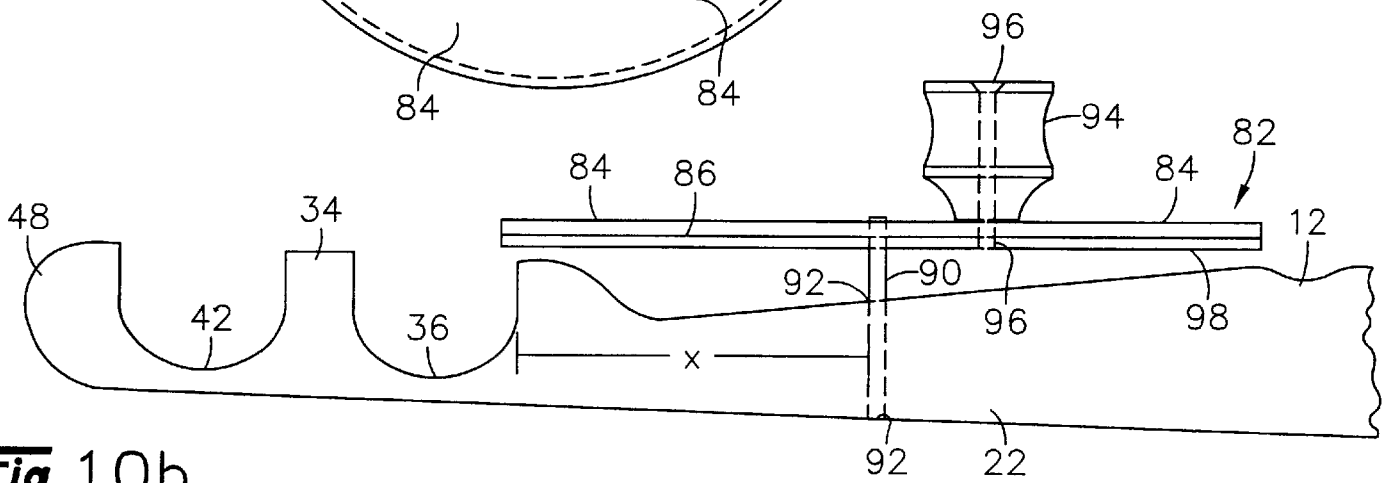

With reference to FIGS. 10*a* and 10*b* there is shown still another embodiment of a carrier 10" having a wheel 80 for accomplishing spinning of the applicators without contact of the applicators with the skin of the user.

For a carrier sized as described previously, the wheel 80 is preferably includes a substantially circular disk 82 with an upper surface 84 and a lower surface 86 and having a thickness of from about ⅛ to about ⅜ inch, preferably about ¼ inch, and a diameter of from about 5 to about 5¼ inches, most preferably about 5⅛ inch. An aperture 88 having a diameter of about ⅛ inch is preferably centrally provided between the surfaces for receiving one end of an axel, such as a brass axel 90. The other end of the axel 90 is preferably received within a similar aperture 92 provided through the section 22 of the carrier. The aperture 92 is preferably spaced from the cutout 42 a distance X of about 2⁷⁄₁₆ inches.

A knob 94 is preferably mounted to the wheel 80 adjacent the upper surface 84 as by a fastener 96 extending through a bore provided centrally through the knob. The knob is preferably radially offset from the center of the wheel by a distance of about ¾ inch. As will be appreciated, the knob 94 may be used to rotate the wheel 80 about the axel, with the lower surface of the wheel positioned to bear against the pressure applicator located within the cutout 36 such that rotation of the wheel 80 results in rotation of the pressure applicator, with rotation of the other pressure applicator being driven by the magnetism of the pressure applicators. In this regard, the periphery of the lower surface preferably includes a soft polymer ring, such as rubber ring 98 adhered to the periphery of the lower surface as by adhesive. The ring preferably has a width of about ¹⁄₁₆ inches and a thickness of about ⅛ inch and provides a surface which frictionally engages a portion of the surface of the pressure applicator so that rotation of the wheel results in direct rotation of the pressure applicator and magnetically driven rotation of the other pressure applicator.

The foregoing description of certain embodiments of the present invention has been provided for purposes of illustration only, and it is understood that numerous modifications or alterations may be made without departing from the spirit and scope of the invention as defined in the following claims.

What is claimed is:

1. A massage system comprising a carrier having a longitudinal axis and at least one pressure applicator having a rotational axis and being rotatably and releasably mountable to the carrier with the rotational axis of the pressure applicator being co-axial with the longitudinal axis of the carrier wherein the carrier covers less than 30% of the surface area of the pressure applicator.

2. The system of claim 1, wherein the carrier comprises an elongate handle portion configured for grasping by a hand of the user and a mounting section longitudinally displaced from the handle portion for rotatably and releasably receiving the pressure applicators, the mounting section covering less than about 30% of the surface area of each pressure applicator.

3. The system of claim 1, wherein the system includes a pair of pressure applicators.

4. The system of claim 3, wherein the pressure applicators are axially aligned and mounted for co-axial rotation.

5. The system of claim 1 wherein the pressure applicators comprise spherical bodies having a plurality of projections extending from an outer surface thereof.

6. The system of claim 5, wherein the projections comprise conical projections, a pair of which on opposite sides of the sphere engage corresponding detents on the carrier for releasably and rotatably mounting the pressure applicators adjacent to the carrier.

7. The system of claim 1, wherein the carrier is made of wood.

8. The system of claim 1, wherein the carrier is made of a polymer.

9. The system of claim 1, wherein the carrier is made of a composite material.

10. The system of claim 1, wherein the pressure applicator is magnetized.

11. A massage system comprising a carrier and a plurality of substantially spherical rigid pressure applicators having outer surfaces rotatably and releasably mounted to the carrier by releasable engagement of the outer surfaces of the pressure applicators, wherein the carrier is graspable by a user for manipulation by the user to simultaneously rotate and press the pressure applicators against body portions of the user or body portions of others, the carrier being configured to maximize exposure of the pressure applicators to the body portions and comprising an elongate handle portion configured for grasping by a hand of the user and a mounting section for rotatably and releasably engaging the outer surface of each pressure applicator, the mounting section being defined by an outer periphery which covers less than 30% of the surface area of each pressure applicator.

12. The system of claim 11, wherein the plurality of pressure applicators comprises a pair of pressure applicators.

13. The system of claim 11 wherein the pressure applicators comprise spherical bodies having a plurality of projections extending from an outer surface thereof.

14. The system of claim 12, wherein the projections comprise conical projections, a pair of which on opposite sides of the sphere engage corresponding detents on the carrier for releasably and rotatably mounting the pressure applicators adjacent to the carrier.

15. The system of claim 11, wherein the carrier is made of wood.

16. The system of claim 11, wherein the carrier is made of a polymer.

17. The system of claim 11, wherein the carrier is made of a composite material.

18. The system of claim 11, wherein the pressure applicators are magnetized and have a magnetic axis transverse to the rotational axis of the applicators.

19. The system of claim 11, wherein the pressure applicators are axially aligned and mounted for co-axial rotation.

20. The system of claim 11, further comprising an extension section located between the handle portion and the mounting section of the carrier.

21. The system of claim 11, wherein the mounting section is longitudinally displaced from the handle portion. rotatably and releasably mountable to the carrier with the rotational axis of the pressure applicator being co-axial with the longitudinal axis of the carrier, wherein the carrier covers less than about 30% of the surface area of the pressure applicator.

22. The system of claim 11, further comprising means for mechanically driving rotation of at least one of the pressure applicators.

23. A carrier for rotatably receiving one or more pressure applicators of the type used for massage therapy, he carrier comprising a handle section and a mounting section operatively associated with the handle section for moving the carrier relative to a user, the mounting section having a longitudinal axis and comprising a cutout section for each applicator to be received, each cutout section having means for receiving at least two portions of one of the pressure applicators such that a rotational axis of each pressure applicator is fixedly co-axial with the longitudinal axis, said mounting section being defined by an outer periphery which covers less than 30% of the surface area of the pressure applicator when received therein.

24. A massage system comprising a carrier having a longitudinal axis at least one pressure applicator having a rotational axis and being rotatably and releasably mountable to the carrier with the rotational axis of the pressure applicator having an outer surface rotatably and releasably mounted to the carrier by releasable engagement of the outer surface of the pressure applicator and being co-axial with the longitudinal axis of the carrier, and means for rotating at least one of the pressure applicators about its rotational axis.

25. The massage system of claim 24, wherein the carrier covers less than about 30% of the surface area of the pressure applicator.

26. The system of claim 24, wherein the means for rotating the pressure applicator comprises a wheel rotatably mounted adjacent to the carrier and having a surface thereof positioned for frictionally engaging one of the pressure applicators.

27. The system of claim 24, wherein the means for rotating the pressure applicator comprises a crank having a first end for rotational manipulation by a user and a second end connected to the first end and positioned adjacent to one of the pressure applicators for frictionally engaging a portion of the pressure applicator.

* * * * *